US005918617A

United States Patent [19]

Garth

[11] Patent Number: 5,918,617

[45] Date of Patent: Jul. 6, 1999

[54] METHOD AND APPARATUS FOR MINIMIZING FLUID DAMAGE PROXIMATE AN APPLIANCE THAT USES FLUID IN ITS OPERATIONAL CYCLE

[76] Inventor: Barry A. Garth, 11911 Skywest Dr., Austin, Tex. 78758

[21] Appl. No.: 08/855,044

[22] Filed: May 13, 1997

[51] Int. Cl.[6] ..... F16K 31/02

[52] U.S. Cl. ..... 137/1; 137/624.11; 137/312; 137/387

[58] Field of Search ..... 137/624.11, 624.12, 137/624.13, 312, 387, 1

[56] References Cited

U.S. PATENT DOCUMENTS

| | | | |
|---|---|---|---|
| 3,392,747 | 7/1968 | Waldrop | 137/624.11 X |
| 3,770,002 | 11/1973 | Brown | 137/312 |
| 4,230,155 | 10/1980 | Frye, Sr. . | |
| 4,249,565 | 2/1981 | Brust | 137/624.11 X |
| 4,298,181 | 11/1981 | Corrado et al. . | |
| 4,412,671 | 11/1983 | Tiefenthaler . | |
| 4,418,712 | 12/1983 | Braley | 137/312 |
| 4,589,435 | 5/1986 | Aldrich | 137/624.11 X |
| 4,712,767 | 12/1987 | Losser et al. . | |
| 4,921,209 | 5/1990 | Moineau . | |
| 5,004,014 | 4/1991 | Bender . | |
| 5,056,554 | 10/1991 | White | 137/624.11 X |
| 5,206,963 | 5/1993 | Wiens et al. . | |
| 5,224,685 | 7/1993 | Chiang et al. | 251/129.04 |
| 5,402,812 | 4/1995 | Bolton et al. . | |
| 5,439,019 | 8/1995 | Quandt et al. | 137/624.11 X |

OTHER PUBLICATIONS

Beeson Engineering–Washer Water Watcher.

Watts–Automatic Shut–Off Valve for Washing Machines.

*Primary Examiner*—Kevin Lee

*Attorney, Agent, or Firm*—Clark, Thomas & Winters, a Professional Corp.

[57] ABSTRACT

A system minimizes fluid damage proximate an appliance that uses fluid in its operational cycle, and has an input from a fluid supply. At least one electrically operated valve is connected to the fluid supply and is actuated to the open position when the operational cycle is initiated. A controller provides an electrical signal to actuate the valve to the closed position upon the termination of a predetermined time or the receipt of an indicia signal indicating that the requirement for fluid for the operational cycle has terminated. Further, fluid sensing structure adjacent the appliance has an output connected to the controller to signal the presence of fluid, in response to which the controller sends an electrical signal to close the electrically operated valve. Still further, a motion detector adjacent the appliance has an output connected to the controller to signal the absence of motion to initiate a pre-determined time period after which the controller provides the electrical signal to actuate the valve to the closed position.

13 Claims, 6 Drawing Sheets

METHOD AND APPARATUS FOR MINIMIZING FLUID DAMAGE PROXIMATE AN APPLIANCE THAT USES FLUID IN ITS OPERATIONAL CYCLE

BACKGROUND OF THE INVENTION

1. Field of the Invention

This invention relates to minimizing fluid damage proximate a fluid-using appliance. More particularly, it pertains to apparatus for automatically shutting off the fluid supply from the appliance to stop the fluid flow between the fluid supply and the appliance.

2. Description of the Related Art

In the past, timers have been used to control the length of time of fluid flow. Gas-fired logs in fireplaces have had gas supplied for a given period of time. Controlling the time during which water can be used for bathing (showering) has also been done. An automatic fluid-sensing and shut-off system for sprinklers has been used in the prior art. Using the absence of electrical current flow in an appliance to close off the fluid supply is known.

However, the prior art does not contemplate minimizing fluid damage from unwanted leakage from supplying an appliance that uses fluid in its operational cycle by closing off the fluid source in the event that a desired length of time has passed, that fluid has been detected proximate the appliance, or the requirement for fluid by the appliance has ended. Sensing moisture under supply hoses to a clothes washing machine and closing off the water supply in response thereto and sounding an alarm is old.

BRIEF SUMMARY OF THE INVENTION

This invention relates to the control of fluid flow to an appliance. More particularly it pertains to shutting off that flow to prevent damage due to leakage involving the appliance.

An electrically controlled valve (or valves) is controlled to open or close by an electrical signal. The electrical signal causes the valve to open when the appliance begins its fluid-using operational cycle. The electrical signal closes the valve, closing off the fluid flow, when there is no further requirement for fluid, after a predetermined time, or when fluid is detected in an unwanted place.

The principal object of this invention is to minimize damage from leakage of fluid supplying a fluid using appliance.

This and other objects will be made evident in the detailed description that follows.

DETAILED DESCRIPTION OF THE INVENTION

This invention involves minimizing damage resulting from fluid leakage of a system in which a fluid supply connects to and supplies a fluid-using appliance with the necessary fluid.

In this preferred embodiment, the appliance is a clothes washing machine and the fluid is water. This, of course, does not preclude other fluid-using machines, but it is used in this preferred embodiment to detail the description of the invention. Also contemplated are dishwashers, icemakers, refrigerators with icemakers, hot water heaters, toilets, water softeners, refrigeration units in refrigerators and coolers, heating appliances using gas, etc.

Figure 1:
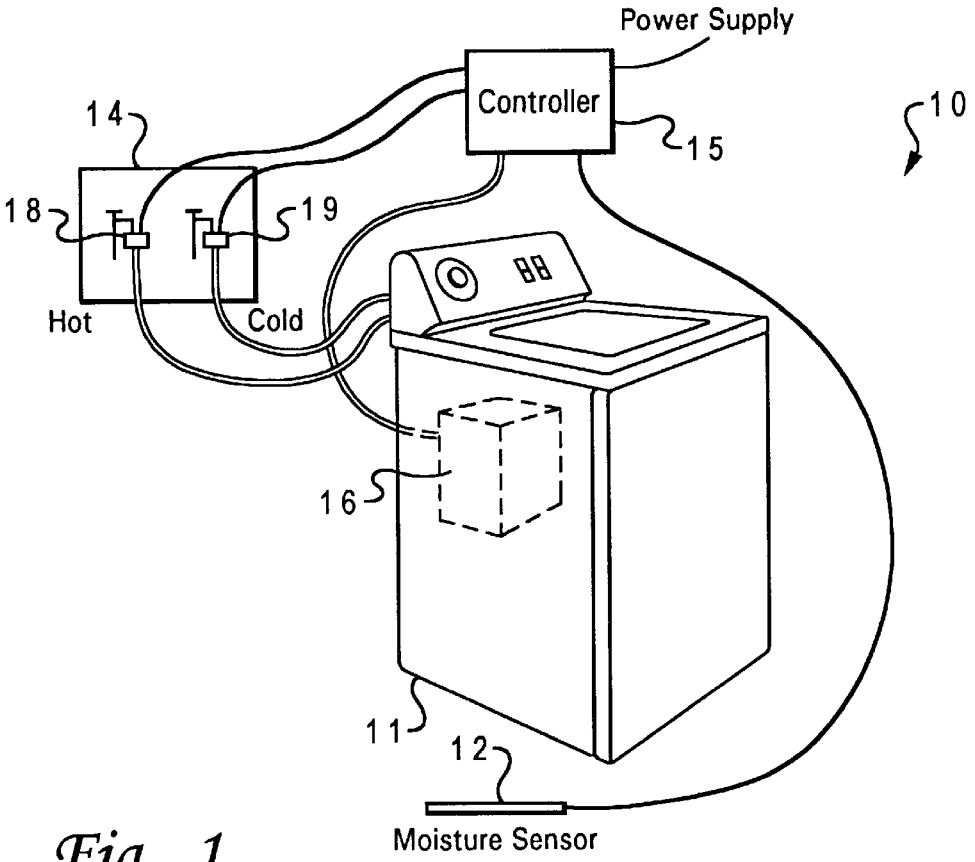
FIG. 1 is a block diagram of the system.

FIG. 1 illustrates a system 10 for minimizing fluid damage, including moisture sensor 12, washing machine controller 16, and controller 15 for controlling the operation of clothes washing machine 11. Moisture sensor 12 is shown electrically connected to controller 15, and washing machine controller 16 is shown also connected to controller 15. Controller 15 is connected to electrically controlled valves 18 and 19 which are connected to the hot and cold water sources respectively. Valves 18 and 19 are Toro remote control valve model No. 53380 in this preferred embodiment. Any comparable valve could also be used.

Controller 15 provides the electrical signal to electrically controlled valves 18 and 19 to open them upon the start of the cycle and to close them when an internal timing cycle of controller 15 is completed, or when washing machine controller 16 signals controller 15 that no more water is required; or if moisture sensor 12 detects moisture, it signals controller 15 to that effect. Moisture sensor 12 is manufactured by Ohmic Instrumentation in this preferred embodiment. Any other equivalent moisture sensor could be used.

Figure 2:
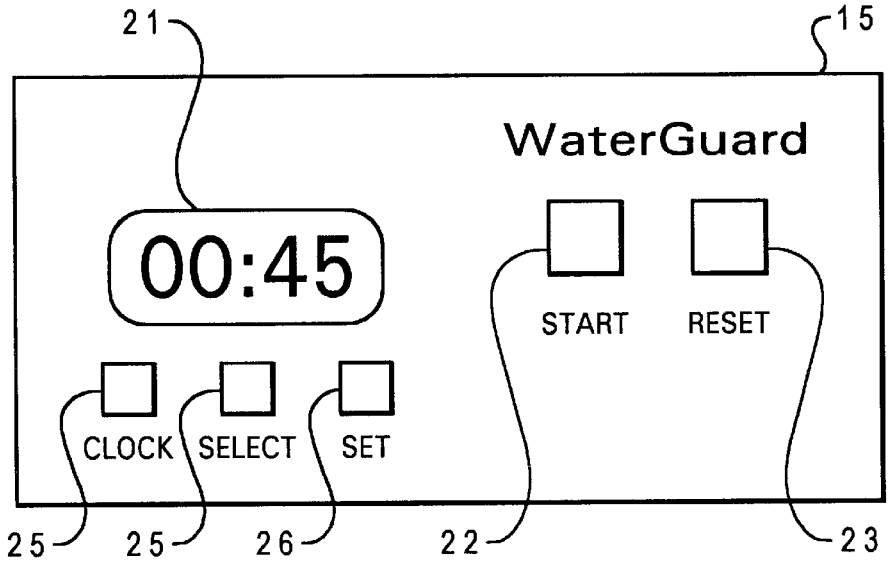
FIG. 2 illustrates the panel of the controller of FIG. 1.

FIG. 2 illustrates the operational panel of controller 15. Display 21 for time display is shown together with start and reset buttons 22 and 23 and time set buttons 24, 25, and 26.

Figure 3:
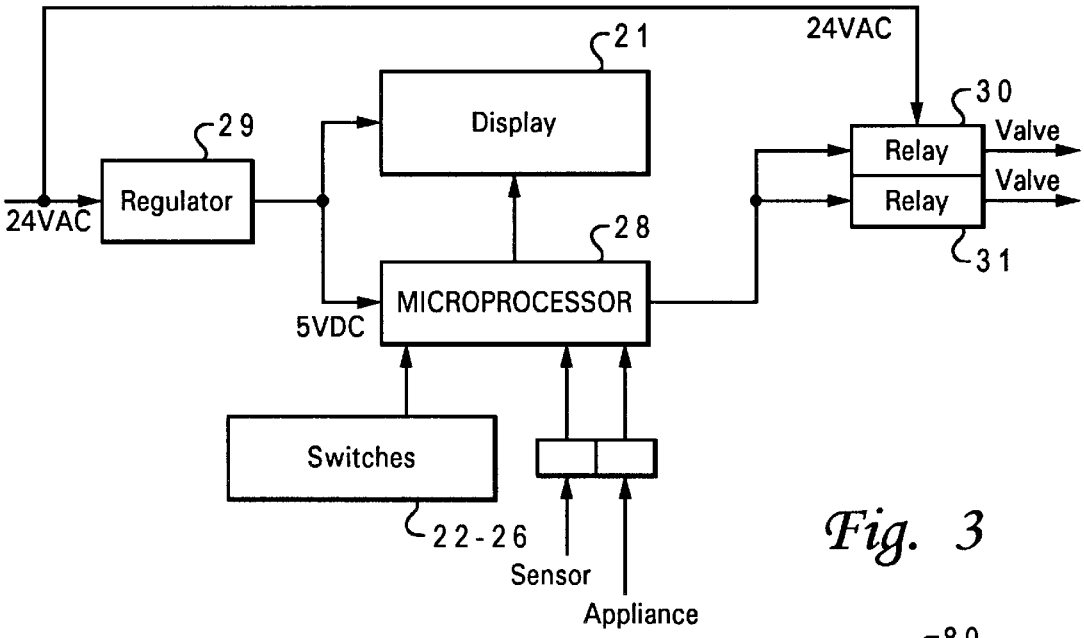
FIG. 3 is a block diagram of the controller of FIG. 1.

FIG. 3 illustrates, in block form, the controller 15 of FIG. 1. Microprocessor 28 is the major component of the controller 15. Microprocessor 28 is manufactured by Microchip, and is a type PIC16C63, in this preferred embodiment. It could, of course, be any other microprocessor suitable for this function. Microprocessor 28 has a sensor input from moisture sensor 12. It also has an appliance input from washing machine controller 16. For controlling display 21, it has input from switches 24, 25, and 26. For starting and stopping the water cycle, through relays 30 and 31, microprocessor 28 has inputs from switches 22 and 23.

A 24-volt A.C. input is provided to regulator 29 which provides five-volt D.C. for the micro-controller 28 and display 21.

Figure 5:
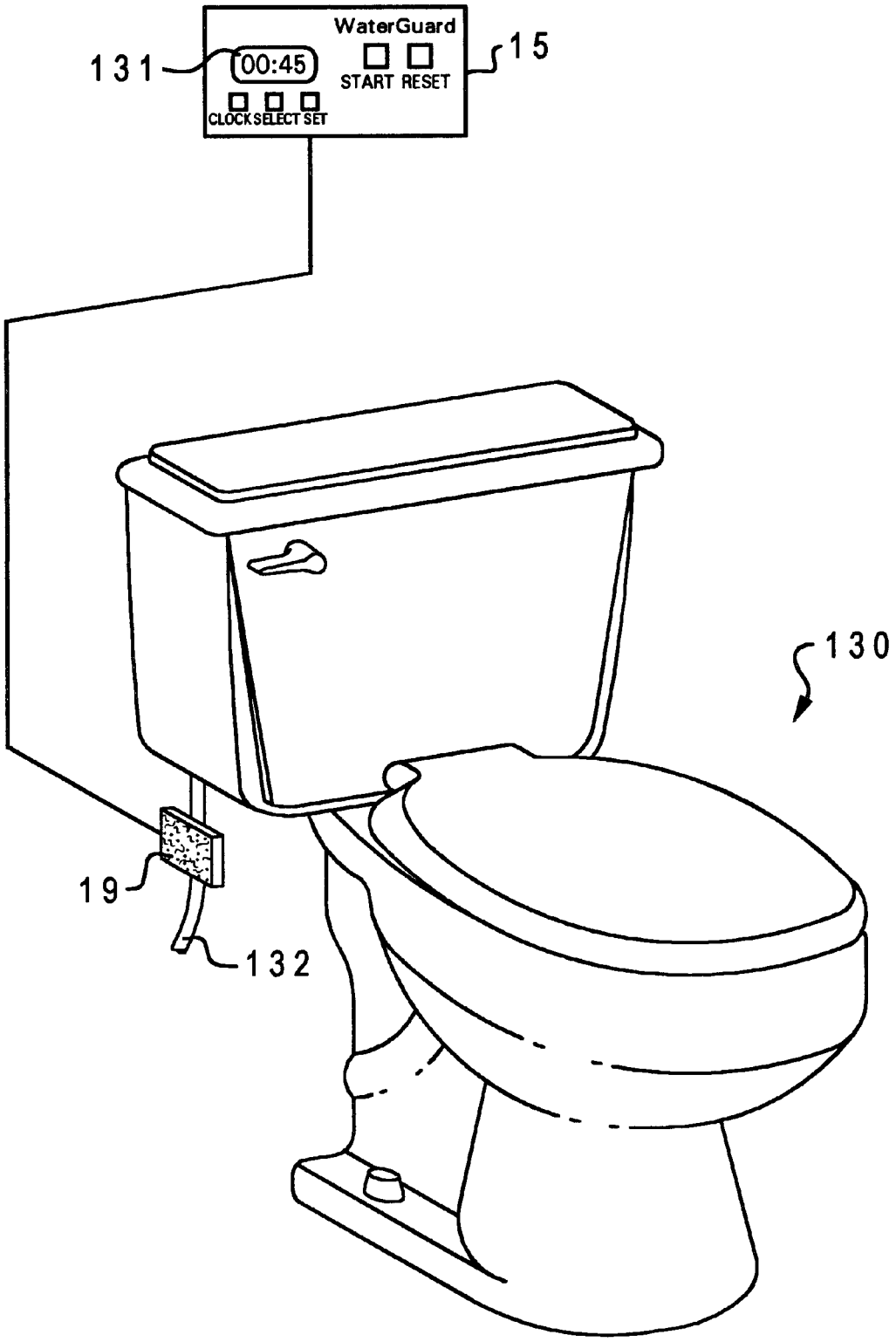
FIG. 5 illustrates a toilet as the applicance.

FIG. 5 illustrates a toilet has an electrically operated cold water valve 19 which is controlled by controller 15. A proximity detector 131 is a OMRON E3F2-DS PHOTO SENSOR. The proximity detector could, of course, be any equivalent detector or sensor.

The proximity detector detects the presence of a user of the toilet, and sends an electrical signal to open valve 19, and upon cessation of such detection, allows controller 15 to complete a timing cycle. Upon the termination of the timing cycle, the controller sends the electrical signal to electrically controlled valve 19 to shut off the water supply to the toilet.

MODE OF OPERATION

In a first embodiment of the invention, start switch 22 is activated, and communicates with microcontroller 28, which in turn activates relays 30 and 31 to open electrically controlled valves 18 and 19. Start switch 22 also activates washing machine 11 to start its wash cycle. Microcontroller 28 is activated to start an internal clock cycle which is generally set by the operator to expire sometime after the washing machine cycle is completed. When the microprocessor timer times out, the electrical signal is sent through the relays 30 and 31 to close electrically controlled valves 18 and 19, respectively. Reset switch 23 will cause the microprocessor to provide the signal at any time to close valves 18 and 19.

If during the wash cycle, and any time before the microprocessor 28 times out, if moisture sensor 12 detects moisture, an initial signal is sent to controller 15 which then sends out the electrical signal through relays 30 and 31 to close valves 18 and 19. Moisture detected by moisture sensor 12 could be a result of leakage from within the washing machine, an overflow of the washing machine, or a ruptured hose. Activation by the operator of reset switch 23 results in communicating that information to microprocessor 28 which then sends the electrical signal through relays 30 and 31 to close valves 28 and 29, respectively.

In a second embodiment, start switch 22 is activated, starting the wash cycle of clothes washing machine 11. Washing machine controller 16, which is signalled to start the washing machine cycle, provides the signal at the end of washing machine cycle which is received by microprocessor 28. Microprocessor 28 sends the electrical signal through relays 30 and 31 to close electrically controlled valves 18 and 19.

As in the first embodiment, if any moisture is sensed by moisture sensor 12, electrically controlled valves 18 and 19 are closed.

FIGS. 4*a*–4*g* are flow charts illustrating the program stored in microprocessor 28 to accomplish the operations set out above.

Figure 4B:
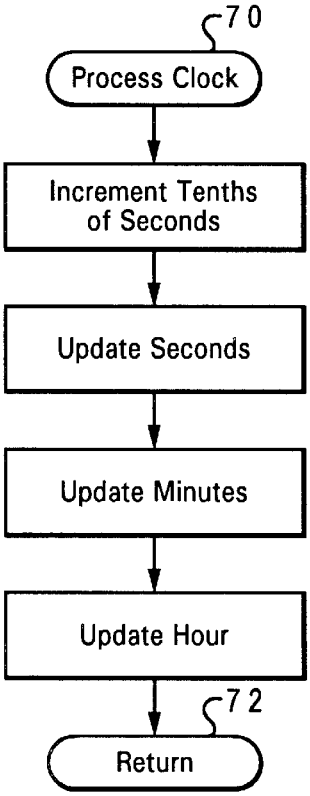
FIGS. 4*a*–4*g* are flow charts of the operation of the microprocessor.
Figure 4C:
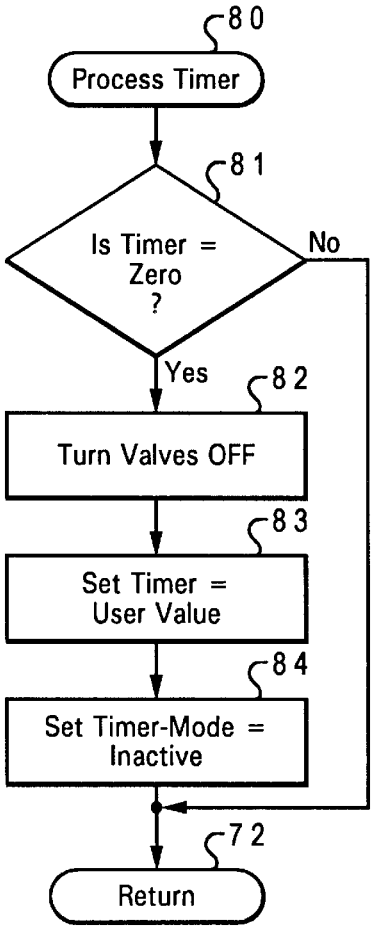
Figure 4A:
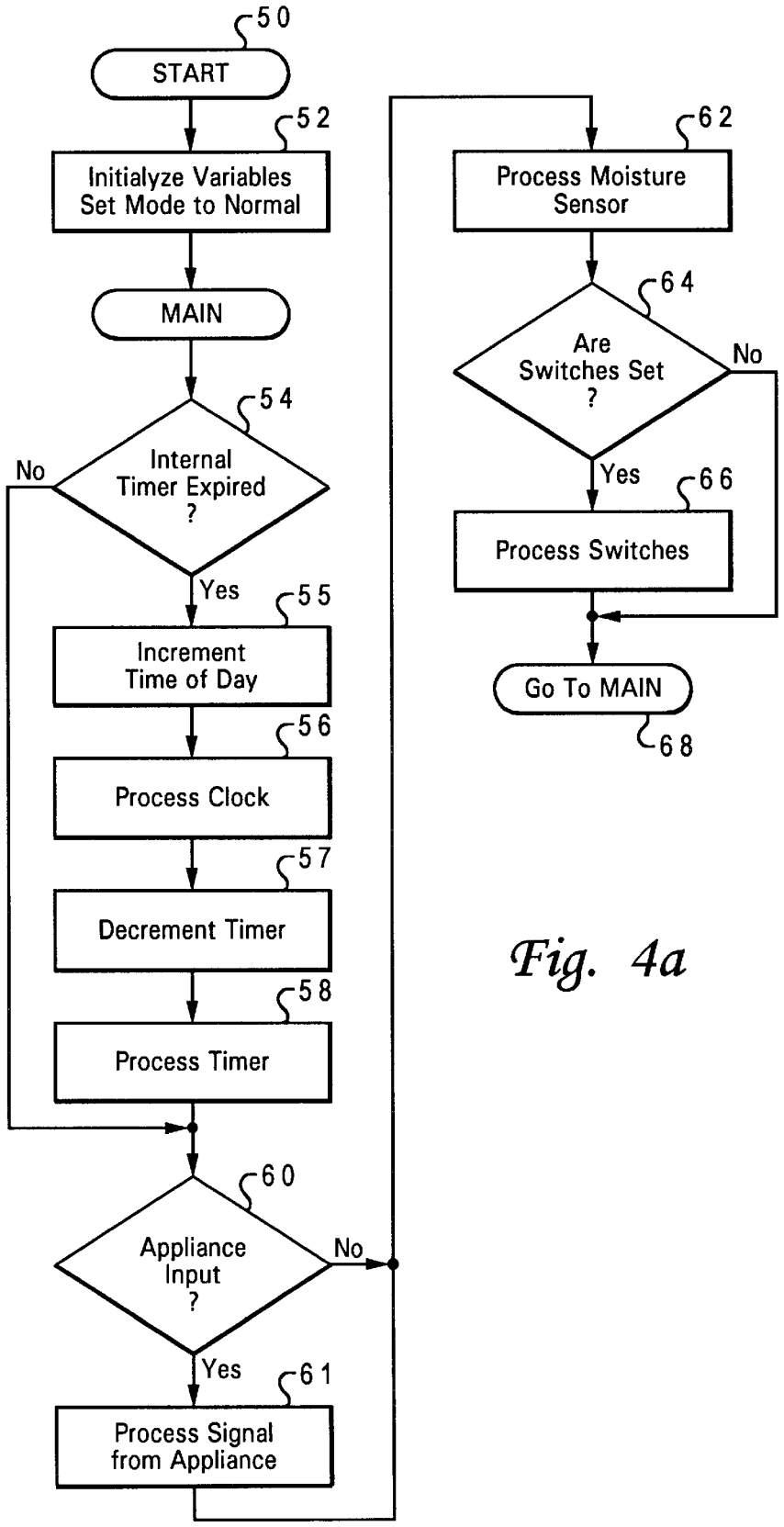

FIG. 4*a* is a flow chart of the general operation of the program. Starting at 50 common variables are set and at 54 the question is asked whether the internal timer has expired. If it has and the time of day in the clock are serviced and at 57 the timer is decremented and processed at 58 (detailed in the following Figures).

At 60, the question is asked "Appliance Input?" If there is, then the signal from the appliance is processed. If there is no appliance input, then the moisture sensor is processed. At 64, the question is asked "Are Switches Set?"; and if the answer is no, go back to 54 to ask whether the internal timer has expired. If the switches are set, then they are processed and the program goes back to 54.

FIG. 4*b* deals with updating the clock for the time of day.

FIG. 4*c* deals with processing the timer, which is microprocessor 28. At 80, the process is started and at 81, if the timer equals 0 then the valves 18 and 19 are turned off. At 82 if the timer is not equal to 0, then, at return 72, the process is repeated. Also, when the timer mode is set to be inactive, at 84 with the valves turned off, the process is again started.

Figure 4D:
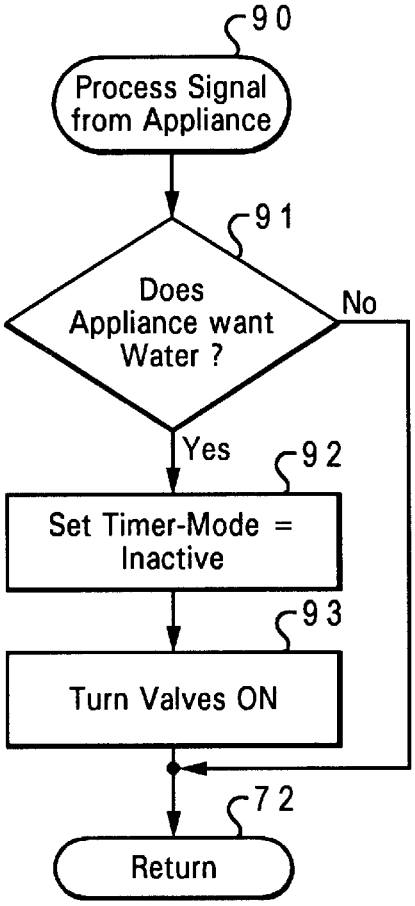

FIG. 4*d* illustrates the program when the signal is supplied by the washing machine. If the question at 91 "Does the Appliance Want Water" is answered affirmatively, at block 92 then the timer mode is set to be inactive and the valves are turned on. If the appliance does not want water at 91, then the signal goes to return at 72 and starts again.

Figure 4E:
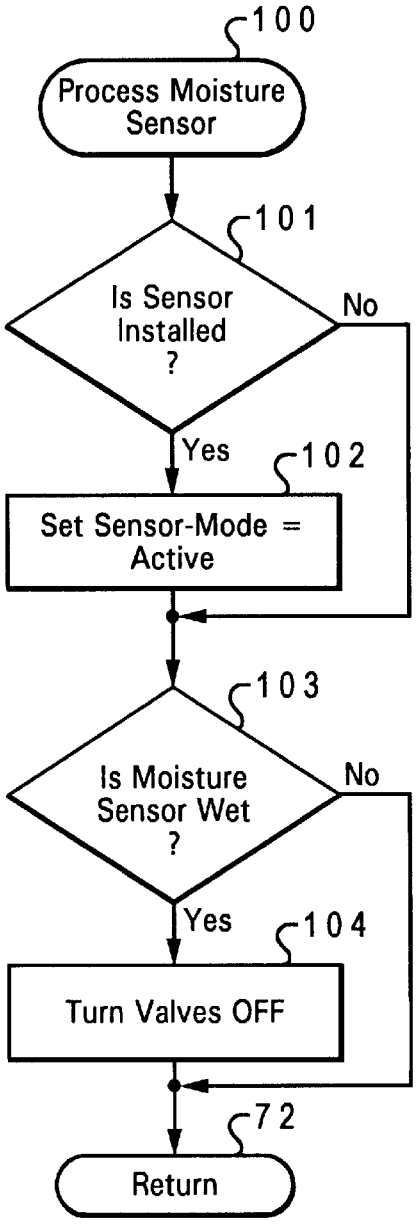

At FIG. 4*e*, the programming for recognizing the moisture sensor is shown. At 101, the question is asked whether the sensor is installed. If it is, then the sensor mode is set active at 102, if not, 102 is bypassed. Then the question at 103 "Is Moisture Sensor Wet?", if affirmative, then at 104 the valves are turned off. If it is not, then block 104 is bypassed, and the process is repeated.

Figure 4F:
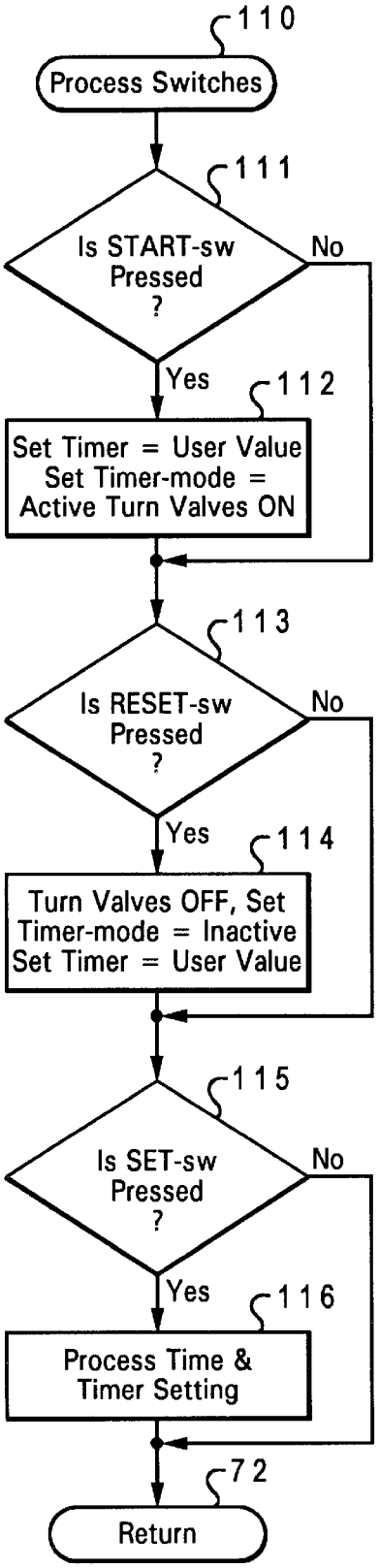

FIG. 4*f* illustrates the program for processing the switches 22–26 on the panel of controller 15. At 111, the question is asked, "Is Start Switch Processed?" If the answer is affirmative, then the timer is set for the user value, and the timer mode is set active, and the valves are turned on. If in the negative, then block 112 is bypassed. To the question at 113, "Is Reset Switch Pressed?", if affirmative, then at block 114, the valves are turned off. The timer mode is set inactive, and the timer is set to user value. If the reset switch is not pressed, block 114 is bypassed; and then at 115, the question is asked, "Is Set Switch Pressed?" If affirmative, then at block 116 the time and timer setting is processed. If negative, then block 116 is bypassed, and the process goes back to interrogating the start switch position.

Figure 4G:
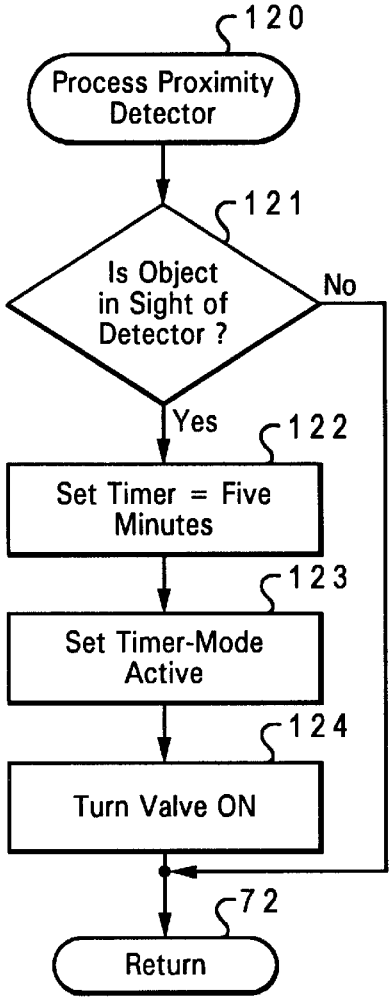

FIG. 4*g* is a flow chart for the use of the proximity detector in connection with this other embodiment of a toilet. At 120 the proximity detector is processed, the valve 19 is opened and at 121, the question is asked whether the object is in sight of the detector. If the answer is yes, then at 122, a timer is set for a pre-determined period and at 123, the timer mode is set active. At 124, the electrically controlled valve is turned off. Had there been no object in sight of the detector at 121, then the program would have skipped directly to 125 and then to return at 72. If the object remains in sight of the proximity detector, then, at 122 the timer is reset; and the cycle repeated.

It is anticipated that one of ordinary skill in the art can make changes to the components and arrangement of components to achieve the results set out herein. However, it is to be noted that the invention is limited only by the appended claims.

What is claimed is:

1. A system for minimizing fluid damage from leakage proximate an appliance that uses fluid in its operational cycle, and has an input from a fluid supply, comprising:

(a) at least one electrically operated valve, located in a position remote from the appliance and adjacent the fluid supply, in an open position for attachment to the fluid supply;

(b) a fluid connection between the valve and the appliance input; and (c) a controller, electrically connected to the valve, including a timer that is set to provide an electrical signal after a predetermined time, to change the valve from the open state to a closed state, closing off the fluid from the fluid supply, the controller further comprising a manually operated start switch for starting the timer and for opening the electrically operated valve.

2. The system of claim 1 wherein the timer comprises a digital processor.

3. The system of claim 2 wherein the digital processor comprises a microprocessor and wherein the controller further comprises a manually operable timing selector, having an output that is electrically connected to the microprocessor for setting the timing function of the microprocessor.

4. The system of claim 3 wherein the fluid comprises water,and further comprising:

(d) moisture sensing means located adjacent the appliance for sensing water and for electrically signaling the microprocessor that water has been sensed to enable the microprocessor to provide the electrical signal in response to such presence of water.

5. The system of claim 4 wherein the water connection comprises at least one hose.

6. The system of claim 1 wherein the controller comprises a microprocessor connected to receive an indicia signal from the appliance that the requirement for fluid has terminated, enabling the microprocessor to provide the electrical signal.

7. The system of claim 6 wherein the fluid connection comprises at least one hose.

8. The system of claim 1 wherein the controller comprises a microprocessor for providing the electrical signal, and a manually operated start switch connected to open the electrically operated valve and to start the appliance.

9. The system of claim 8 wherein the fluid comprises water, and further comprising:

(d) moisture sensing means located adjacent the appliance for sensing water and for electrically signaling the microprocessor that water has been sensed to enable the microprocessor to provide the electrical signal in response to such presence of water.

10. The system of claim 1 wherein the fluid is water, the appliance is a toilet, and the valve is in the closed state, further comprising:

(d) a proximity detector for detecting the presence of water near the toilet, and connected to the controller for providing the electrical signal to open the valve, and a start signal for the timer to start a pre-determined time period after which the electrical signal is provided to change the valve from the open state to a closed state, thereby closing off the water from the fluid supply.

11. A system for minimizing water damage from leakage proximate a clothes washing machine, having an input from a water supply, comprising:

(a) at least one electrically operated valve, positioned remotely from the clothes washing machine and adjacent the water supply, settable to an open or a closed state, for attachment to the water supply;

(b) at least one hose connected to the electrically operated valve and to the washing machine input;

(c) a controller, comprising:

(i) a microprocessor for controlling the open and closed state of the electrically operated valve by providing an electrical signal to the valve for changing to the open or closed state, and for acting as a timer to provide the electrical signal after a predetermined time to cause the electrically operated valve to assume the closed state, and (ii) a manually operated start switch electrically connected to the microprocessor for enabling the microprocessor to provide the electrical signal to cause the electrically operated valve to assume the open state, and to enable the microprocessor to act as a timer; and (d) a moisture sensing pad located under the washing machine and electrically connected to the microprocessor for enabling the microprocessor to provide the electrical signal to change the electrically operated valve to the closed state when moisture has been sensed.

12. A system for minimizing water damage from leakage proximate a clothes washing machine, having an input from a water supply, comprising:

(a) at least one electrically operated valve, positioned remotely from the clothes washing machine and adjacent the water supply, settable to an open or closed state, for attachment to the water supply;

(b) at least one hose connected to the electrically operated valve and to the washing machine input;

(c) a controller, comprising:

(i) a microprocessor for controlling the open and closed state of the electrically operated valve by providing an electrical signal to the valve for changing to the open or closed state, and for detecting the termination of water in the operational cycle of the washing machine and for providing the electrical signal in response to such detection, and (ii) a manually operated start switch, electrically connected to the microprocessor for enabling the microprocessor to provide the electrical signal to change the electrically operated valve to assume the open state; and (d) a moisture sensing pad located under the washing machine and electrically connected to the microprocessor for enabling the microprocessor to provide the electrical signal to change the electrically operated valve to the closed state when moisture has been sensed.

13. A method of minimizing fluid damage resulting from fluid leakage proximate an appliance that uses fluid in its operational cycle, and has an input from a fluid supply, comprising the steps of:

(a) attaching at least one electrically operated valve to and adjacent the fluid supply;

(b) connecting at least one hose between the valve and the appliance input:

(c) starting the operational cycle and, at the same time, opening the valve by providing an electrical signal thereto;

(d) closing the valve after a desired time by again providing the electrical signal.

* * * * *